US008418420B2

(12) United States Patent
Sawada

(10) Patent No.: US 8,418,420 B2
(45) **Date of Patent: *Apr. 16, 2013**

(54) WINDOW DRAIN

(75) Inventor: Koji Sawada, Anjo (JP)

(73) Assignee: Nichiha Corporation, Nagoya-Shi (JP)

( * ) Notice: Subject to any disclaimer, the term of this patent is extended or adjusted under 35 U.S.C. 154(b) by 0 days.

This patent is subject to a terminal disclaimer.

(21) Appl. No.: 13/049,947

(22) Filed: Mar. 17, 2011

(65) Prior Publication Data

US 2011/0162284 A1 Jul. 7, 2011

Related U.S. Application Data

(62) Division of application No. 12/216,316, filed on Jul. 2, 2008, now Pat. No. 7,941,980.

(30) Foreign Application Priority Data

Jul. 2, 2007 (JP) ..... 2007-005039 U

(51) Int. Cl.
*E06B 7/14* (2006.01)

(52) U.S. Cl.
USPC ..... 52/209; 52/97; 49/408

(58) Field of Classification Search ..... 52/209, 52/58, 302.6, 302.1, 97; 49/408, 476.1
See application file for complete search history.

(56) References Cited

U.S. PATENT DOCUMENTS

| | | | | |
|---|---|---|---|---|
| 868,413 A | | 10/1907 | Cramer | |
| 2,648,107 A | * | 8/1953 | Bates, Jr. | 52/97 |
| 2,697,932 A | | 12/1954 | Goodwin | |
| 2,732,045 A | * | 1/1956 | Herlocker | 52/97 |
| 2,856,995 A | | 10/1958 | Roth | |
| 2,918,706 A | | 12/1959 | Rust et al. | |
| 3,862,531 A | * | 1/1975 | Attaway et al. | 52/300 |
| 4,154,033 A | | 5/1979 | Krueger et al. | |
| 4,241,549 A | * | 12/1980 | Hall et al. | 52/60 |
| 4,492,062 A | * | 1/1985 | Levenez | 52/97 |
| 4,555,882 A | * | 12/1985 | Moffitt et al. | 52/209 |
| 4,858,406 A | * | 8/1989 | Lane et al. | 52/300 |
| 5,123,212 A | | 6/1992 | Dallaire et al. | |
| 5,189,853 A | * | 3/1993 | Braine et al. | 52/96 |
| 5,887,387 A | | 3/1999 | Dallaire | |
| 5,921,038 A | | 7/1999 | Burroughs et al. | |

(Continued)

FOREIGN PATENT DOCUMENTS

| | | |
|---|---|---|
| JP | 8-100578 A | 4/1996 |
| JP | 2004-353198 A | 12/2004 |

*Primary Examiner* — William Gilbert
*Assistant Examiner* — Gisele Ford
(74) *Attorney, Agent, or Firm* — Birch, Stewart, Kolasch & Birch, LLP

(57) ABSTRACT

A window drain for preventing stains on a building wall and damage caused by (frozen) rain water, which is installable and sealable easily without impairing the appearance of a building. The present invention relates to a window drain adaptable to be positioned beneath a sill of a sash window frame having a vertical portion, a sloping portion, a front portion, and a horizontal portion for latching to an upper portion of an external wall. Further, the present invention relates to a window drain, wherein the horizontal portion has notches at both ends thereof. Further, the present invention relates to a window drain, further having upstanding portions at both ends of the window drain to regulate a stream of water so that the water is kept between the upstanding portions.

3 Claims, 3 Drawing Sheets

U.S. PATENT DOCUMENTS

| | | | | |
|---|---|---|---|---|
| 6,038,821 | A | 3/2000 | Larson et al. | |
| 6,170,207 | B1 | 1/2001 | Saindon | |
| 6,385,925 | B1 | 5/2002 | Wark | |
| 6,484,446 | B2 | 11/2002 | Young | |
| 6,578,322 | B2 * | 6/2003 | Kintop | 52/96 |
| 2005/0210768 | A1 | 9/2005 | Lawson et al. | |
| 2008/0245001 | A1 | 10/2008 | Alkoury et al. | |
| 2009/0007505 | A1 * | 1/2009 | Sawada | 52/209 |
| 2009/0272045 | A1 | 11/2009 | Teodorovich | |

* cited by examiner

WINDOW DRAIN

This application is a Divisional of application Ser. No. 12/216,316, filed on Jul. 2, 2008, now U.S. Pat. No. 7,941,980 the entire contents of which are hereby incorporated by reference and for which priority is claimed under 35 U.S.C. §120.

This non-provisional application claims priority under 35 U.S.C. §119(a) on Japanese Patent Application No. JP2007-005039U, filed on Jul. 2, 2007, which is herein incorporated by reference.

FIELD OF THE INVENTION

The present invention relates to a window drain adapted to be positioned beneath a sash window frame of a building.

BACKGROUND OF THE INVENTION

A variety of structures of window drains are known in the art. For example, in the case where a window drain is installed underneath a sash window frame, a window drain having a vertical portion which is fixable to a wall and further wherein the vertical portion has holes (openings) for accepting a screw to fix the window drain is known. The hole extends downwardly and an end of the hole is open so that an adjustment in a vertical direction can be carried out easily. Further, a window drain may have a round concave portion so that sealing material can be filled into the space between an external wall and the window drain. (JP 08-100578 A.)

Further, a window drain for preventing rain water drops can be installed beneath a sash window frame so that the window drain extends from an external wall so as to prevent stains caused by rain water and damage caused by frozen water. Such a window drain has a guide portion and a contact portion contacting an external wall. The guide portion has an upper portion inclining downwardly, a front portion extending vertically, a curved portion which smoothly connects the upper portion and the front portion, and a curve at the end of the front portion. (JP 2004-353198 A).

However, it is usually necessary to provide a space of approximately 10 mm, for example, so that a sealing material can be installed and fixed between a lower portion of the window frame and an upper portion of the external wall. In accordance with the method of JP 08-100578 A, there are drawbacks. For example, another sealing means must be employed and fixed at the proximity of an upper portion of a window drain so as to seal the space between a window drain and the external wall. Consequently, two (2) sealing portions are visible and the appearance at the proximity of the window drain is impaired. Further, when such a window drain is installed, it is usually necessary for a worker(s) to install and fix the window drain in a suitable position with screws, while holding the window drain by hand. Such a process is troublesome, and also it is difficult to install and fix a window drain in the correct position.

BRIEF SUMMARY OF THE INVENTION

A primary object of the present invention is to substantially eliminate such problems of conventional technologies. For example, according to the present invention, a window drain can be installed and sealed more easily and thus workability can be improved. Furthermore, another object is to provide a window drain, which can prevent stains caused by rain drops and damage caused by frozen water (e.g., frozen rain) effectively, without impairing the appearance of a building in which the window drain is installed.

To achieve the above mentioned objects, the present invention provides a window drain adapted to be positioned beneath a sill of a sash window frame having a vertical portion, a sloping portion, a front portion and a horizontal portion for latching to an upper portion of an external wall. Further, the present invention is directed to a window drain wherein the horizontal portion has notches at both ends thereof. Further, the present invention comprises a window drain, further comprising upstanding portions at both ends of the window drain to regulate a stream of water so that the water is kept between the upstanding portions. Further, the present invention is related to a window drain adapted to be positioned beneath a sill of a sash window frame having a horizontal portion for latching itself to an upper portion of an external wall, a sloping portion extending downwardly from the horizontal portion, a vertical portion extending downwardly from the upper portion of the sloping portion, and a front portion extending downwardly from the lower end of the sloping portion.

Usually, approximately 10 mm of space, within which a sealing material is inserted and fixed, is provided between the sill of a sash window frame and the upper portion of an external wall. According to the present invention, since the window drain has a horizontal portion for latching itself to an upper portion of an external wall, the window drain can be disposed so that the horizontal portion is located between a sill of a sash window frame and an upper portion of an external wall. Consequently, it is unnecessary to hold the window drain by hand so as to keep the window drain on the external wall when installing the window drain. This is an advantageous property of the present invention.

Further, since the sealing is located underneath the lower portion of the sash window frame, the sealing can be kept in as low a profile as possible. Thus, it is not very visible. Further, since a window drain is disposed at the position close to the sealing material, the appearance of the window drain and the proximity thereof is apparently simplified and thus an excellent appearance is obtained. Further, since a horizontal portion for latching to an upper portion of an external wall has notches at both ends of a window drain, the surface of the external wall adjacent to the sealing material can also be sealed and thus adhesiveness between an external wall and the sealing can be improved effectively.

Further, it is preferable that a window drain have upstanding portions in order to regulate a stream of rain water at the right and left ends of the drain. Rain water is received by a window drain and regulated by the upstanding portions so that it goes downwardly between the upstanding portions. Therefore, rain water is effectively prevented from touching the external wall. Consequently, stains on an external wall caused by rain water and damage caused by frozen water can be effectively avoided.

BRIEF DESCRIPTION OF THE DRAWINGS

The present invention will become more fully understood from the detailed description given hereinbelow and the accompanying drawings, which are given by way of illustration only, and thus are not limitative of the present invention, and wherein:

FIGS. 3A, 3B-1, 3B-2 and 3C are perspective views (from underneath) of a window drain to be installed to a sash window frame (FIG. 3A), an enlarged view of ends of a window drain (FIGS. 3B-1, 3B-2), and a front view of a window drain having been installed beneath a sash window frame (FIG. 3C), respectively.

DETAILED DESCRIPTION OF THE INVENTION

The present invention is explained hereinbelow with reference to the Figures. However, the Figures are provided to illustrate the present invention. They should not be construed as limiting the scope of the present invention.

(Window Drain)

Figure 1:
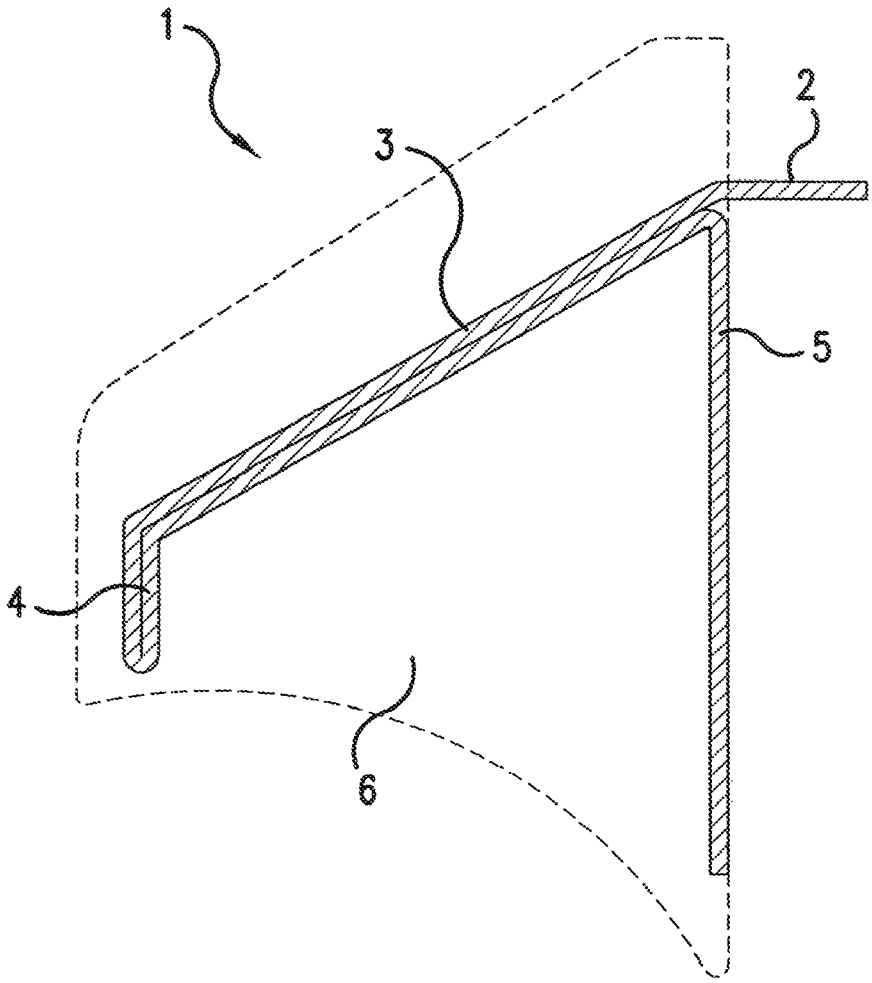
FIG. 1 is a sectional view of a window drain of the present invention.
Figure 2:
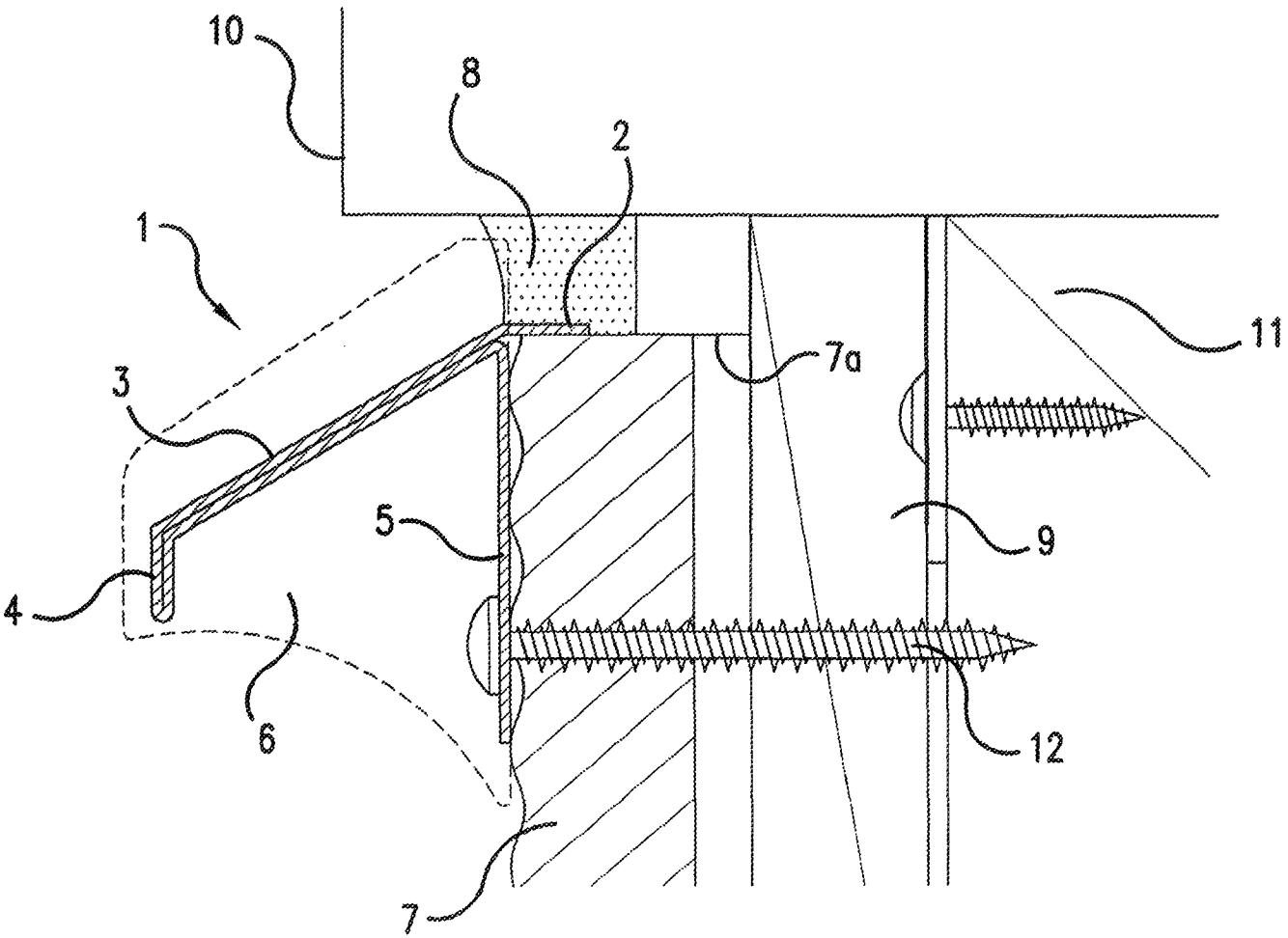
FIG. 2 is a sectional view of a window drain of the present invention, installed under a sash window frame.
Figure 3A:
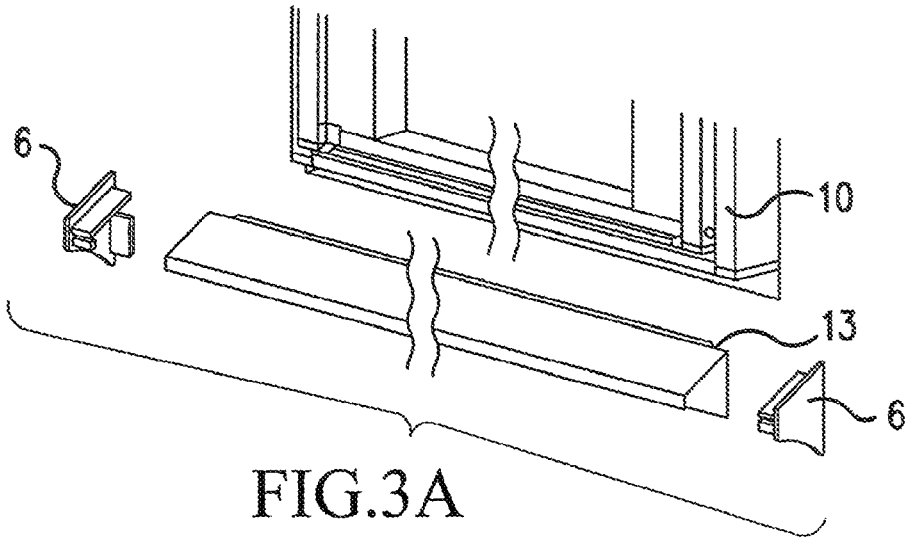

As shown in FIGS. 1 and 2, a window drain (1) has a vertical portion (5), a sloping portion (3), a front portion (4), and a horizontal portion (2) for latching the window drain to an upper portion of an external wall (7*a*). The window drain can be installed between a lower portion of a sash window frame and an upper portion (7*a*) of an external wall (7). Further, as shown in FIG. 3A and FIGS. 3B-1 and 3B-2, a horizontal portion for latching to an upper portion of an external wall (2) can have notches (13) at both ends. Further, as shown in FIGS. 3A and 3C, a window drain (1) can have an upstanding portion (6) to regulate the flow of (rain) water at both ends thereof. The material for such an upstanding portion is not limited. For example, such an upstanding portion can be made of metallic material or a resin.

(External Wall Material)

As the material for an external wall, for example, a cement board containing wooden reinforcement material such as wood chips, wood pulp, wood fiber and pulp (e.g., a wood chip cement board), a cement board formed by extrusion molding, a pulp cement board, a gypsum board, a calcium silicate board, a magnesium carbonate board, and a cement board can be employed.

(Sealing Material)

It is preferred that the sealing material seals the proximity of an upper portion of an external wall and has enough flexibility to follow shrinkage or swelling of an outer wall, which may occur after installation, so as to maintain the sealing property without cracks or separation. There is no particular limitation with respect to the sealing material. However, for example, a modified silicone polymer base sealing material, polysulfide polymer base sealing material, polyurethane polymer base sealing material, acrylic polymer base sealing material, or a butyl rubber base sealing material can be employed. Among them, a sealing material having sufficient elasticity such as a modified silicone polymer base sealing material, polysulfide polymer base sealing material and polyurethane polymer base sealing material can be preferably employed.

EXAMPLE

The present invention will hereinafter be described based on a specific Example. However, the Example is provided to illustrate the present invention, but it should not be construed as limiting the scope of the present invention.

Example 1

An example of a procedure for installing a window drain in accordance with the present invention is explained below.

A window drain (1) having a horizontal portion for latching to an upper portion of an external wall (2), a sloping portion (3), a front portion (4), and a vertical portion (5), is shown in FIG. 1. As shown in FIG. 2, a sash window frame (10) is fixed to a building wall or a post (11), which is positioned underneath a sash window frame, with screws. Further, a furring strip (9) is installed as a support for an external wall (7) under the sash window frame (10). Further, the window drain (1) is temporarily held so that the horizontal portion touches an end (7*a*) of the external wall (7). Then, while keeping the vertical portion (5) touching the external wall (7), the position to be installed is adjusted and then is fixed to external wall (7) with screws (12). In FIG. 2, the portion described with a broken line is an end-cap (an upstanding portion) (6).

Figures 1, 3B:
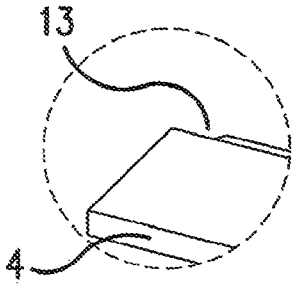
Figures 2, 3B:
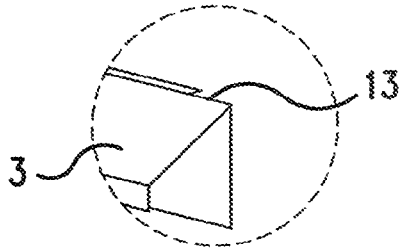
Figure 3C:
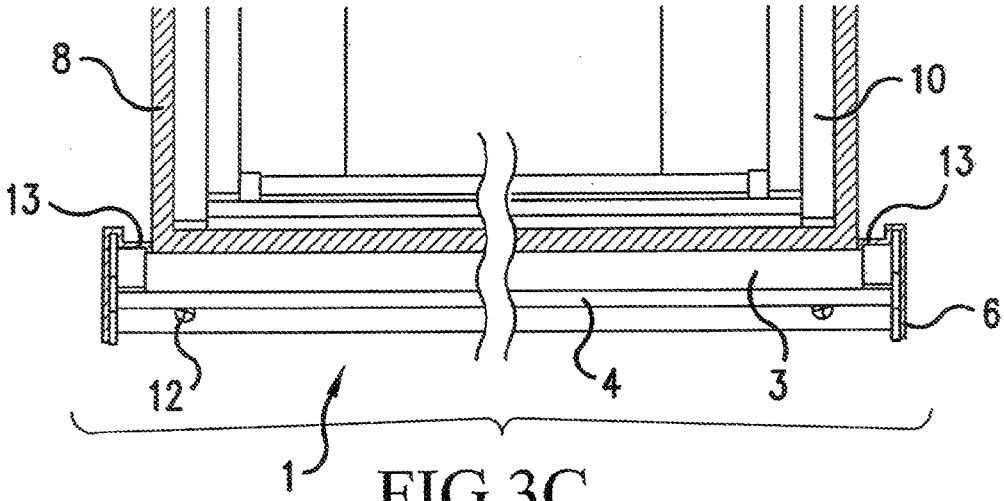

As shown in FIGS. 3B-1 and 3B-2, a sealing material (8) is disposed around a sash window frame (10), and a window drain (1) is installed. A horizontal portion (2) of the window drain (1) is notched so that the horizontal portion has notches (13) of approximately 10-15 mm at both ends of the horizontal portion. The notches are provided so that the window drain (1) can be inserted easily and further that the surface of the external wall adjacent to the sealing material (8) can also be sealed so as to surely receive rain water, which slips downwardly on the sash window frame (10). Another object is to keep adhesiveness between an external wall (7) and the sealing material (8) in good condition. Then, the vertical portion (5) is fixed to the external wall (7) with a screw (12). After fixing, end-caps (as upstanding portions) (6) for regulating a stream of rain water are attached to both ends of a window drain (I) with glue. After installing the window drain, the sealing (8) is installed to and fixed at the space between the sash window frame (10) and the external wall (7).

Accordingly, since the sealing material is located underneath the sash window frame (10), the sealing material can be hidden effectively so as not to be substantially visible. Further, since the sealing can be completed by scaling only the space between the sash window frame (10) and the external wall (7), such an installation can be carried out easily and sealing is secured effectively.

Unlike conventional window drains and structures for preventing rain water from slipping down on the wall, according the present invention, since the window drain can be held at the space to which a sealing material is to be inserted on an external wall by latching a horizontal portion thereof to an upper portion of the external wall, it can be installed easily. Further, since the window drain is disposed so that the horizontal portion covers the upper portion of the external wall together with the sealing material, it is not necessary for an extra sealing material to be installed on the window drain. Consequently, the window drain of the present invention can be installed easily and further, an excellent appearance of the window drain and the proximity thereof (e.g., a simpler appearance) can be obtained.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A window drain system comprising:

a sash window frame having a sill;

an external wall;

a sealing;

a screw; and a window drain comprising:

a horizontal portion for latching itself to an upper portion of the external wall;

a sloping portion extending downwardly from the horizontal portion;

a vertical portion extending linearly and downwardly from the upper end of the sloping portion and having a screw hole so that the vertical portion can contact a from surface of the external wall and be fixed on the from surface or the external wall with a screw; and a front portion extending downwardly from the lower end of the sloping portion, wherein the sloping portion extends downwardly from an upper end of the vertical portion and the horizontal portion linearly extends from the upper end of the vertical portion in the opposite direction of the sloping portion, and the vertical portion and the horizontal portion from approximately a right angle, wherein the sealing is disposed between the sill of the sash window frame and the upper portion of the external wall, and further the horizontal portion is disposed between the sealing and the upper portion of the external wall, and a width of the sloping portion is wider than a width of the sill of the sash window frame, the horizontal portion is disposed on the upper portion of the external wall, and the vertical portion is disposed and fixed on the front surface of the external wall with the screw.

2. The window drain structure of claim 1, further comprising upstanding portions at both ends of the window drain to regulate a stream of water so that he water is kept between the upstanding portions.

3. The window drain structure of claim 1, wherein the screw hole of the vertical portion is located at a lower portion than a lower end of the front portion.

* * * * *